United States Patent [19]

Sepke

[11] Patent Number: 4,903,911

[45] Date of Patent: Feb. 27, 1990

[54] HOSE REEL FOR CENTRAL VACUUM CLEANING SYSTEM

[75] Inventor: Arnold L. Sepke, Hudson, Ill.

[73] Assignee: The Eureka Company, Bloomington, Ill.

[21] Appl. No.: 261,686

[22] Filed: Oct. 24, 1988

[51] Int. Cl.[4] ..... B65H 75/18

[52] U.S. Cl. ..... 242/86; 242/125.2; D8/358

[58] Field of Search ..... 242/86, 86.1, 86.2, 242/125.2; 137/355.16, 355.26; D8/358, 359; 206/389

[56] References Cited

U.S. PATENT DOCUMENTS

| | | | |
|---|---|---|---|
| 549,202 | 11/1895 | Landon | 242/86.2 |
| 574,419 | 1/1897 | Hartzell | 242/86.2 |
| 2,935,996 | 5/1960 | Anderson | 242/86 |
| 3,168,260 | 2/1965 | Kittelson | 242/86.1 |
| 3,384,140 | 5/1968 | Brothers | 206/389 X |
| 3,536,275 | 10/1970 | Salomon | 242/86 |
| 4,330,005 | 5/1982 | Kjarsgaard | 242/86 X |
| 4,660,782 | 4/1987 | Hegemann | 242/86 |

*Primary Examiner*—Stuart S. Levy
*Assistant Examiner*—Steven M. duBois
*Attorney, Agent, or Firm*—Alfred E. Miller

[57] ABSTRACT

A portable hose reel for a central vacuum cleaning system with a pair of spaced discs connected by an axle for winding the hose thereon. One of the discs is provided with a hole which accommodates a rigid connector for the hose. The connector additionally functions as a crank handle. The reel has a stand which can be used as a carrying handle and as a hanger element for the hose reel.

7 Claims, 3 Drawing Sheets

HOSE REEL FOR CENTRAL VACUUM CLEANING SYSTEM

The present invention relates to a central vacuum cleaning system and more particularly to a hose reel for transporting an approximately 30–35 foot hose length from room to room in a house or building equipped with a central vacuum system, as well as storing the hose in a minimum of space. A central vacuum system is well known which has a main vacuum apparatus, such as the motor housing, and a dirt receptacle mounted in a centralized area of the building. The main unit is connected to the various rooms in the building with an air-tight, rigid tubing system which is generally concealed within the walls of the building. The tubing for each room terminates with a special wall mount hose receptacle to which a flexible hose is attached for vacuuming the various rooms in the building. Of course, the flexible hose is connected at one end to various cleaning attachments while the other end is inserted into the vacuum wall receptacle. Consequently, the coupling between the flexible hose and the rigid tubing of the central vacuum system creates an air-tight seal between the hose end and the wall receptacle. A switch mechanism is employed to activate the motor in the main vacuum system, thus creating a suction for vacuuming the various rooms in the building.

It is a principle feature of the present invention to overcome the problem of storing and transporting the lengthy flexible hose that is required in central vacuum systems. Because of the extraordinary length of the hose and the rather large diameter of the hose itself, the usual coiling arrangement of vacuum cleaner hoses employed on smaller portable cleaning devices is not applicable to a central vacuum system. Consequently, the movement of this lengthy hose without kinking, as well as uncoiling, presents a difficult task to the ordinary user. Furthermore, the transport of the central vacuum system hose from room to room also is difficult.

The present invention overcomes the problem of both transport of the lengthy flexible hose as well as storage. In the case of the latter, the present arrangement permits the hose to be coiled on a reel in a simple and rapid manner and hung on a hook or other projection on the wall of the closet, thus taking up a minimum of space in the closet.

A further feature of the present invention is to provide a means for preventing the hose from uncoiling by accident after it has been coiled on the reel.

Another feature of the present invention is to provide spaced discs or flanges forming a reel in which one of the flanges discs is provided with an opening through which a rigid hose connector end is placed therethrough and thereby can function as a handle for cranking the reel, and at the same time functions as a securement for one end of the hose.

It is a further object of the present invention to provide a vacuum cleaner hose reel which is light in weight, and inexpensive to manufacture, and is provided with a stand which also functions as both a handle and a support member for hanging the hose reel on the wall of a closet.

In order that the present invention will be more clearly understood, it will now be disclosed in greater detail with reference to the accompanying drawings in which.

DESCRIPTION OF THE PREFERRED EMBODIMENT

Figure 1:
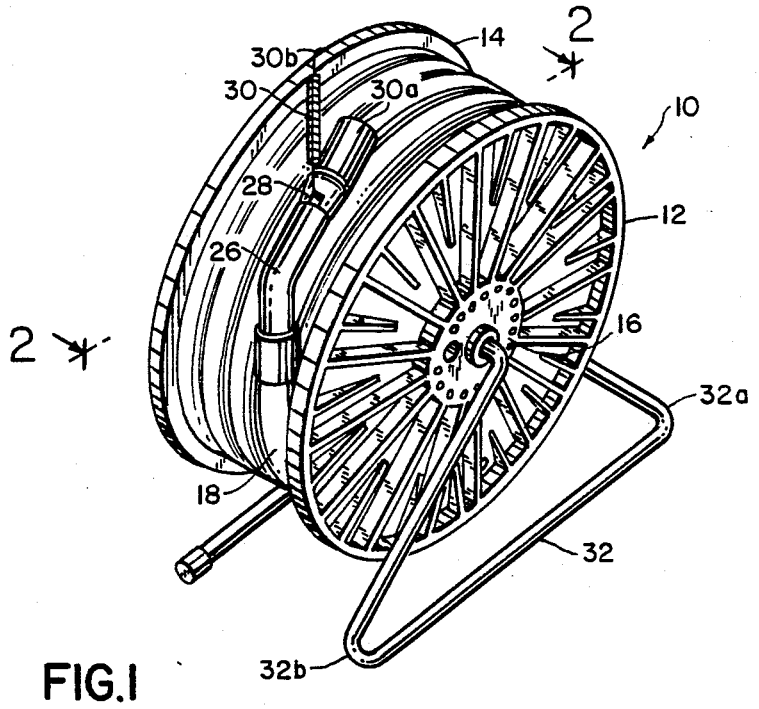
FIG. 1 is a perspective view of the hose reel and hose for the central vacuum system constructed in accordance with the teachings or the present invention.
Figure 2:
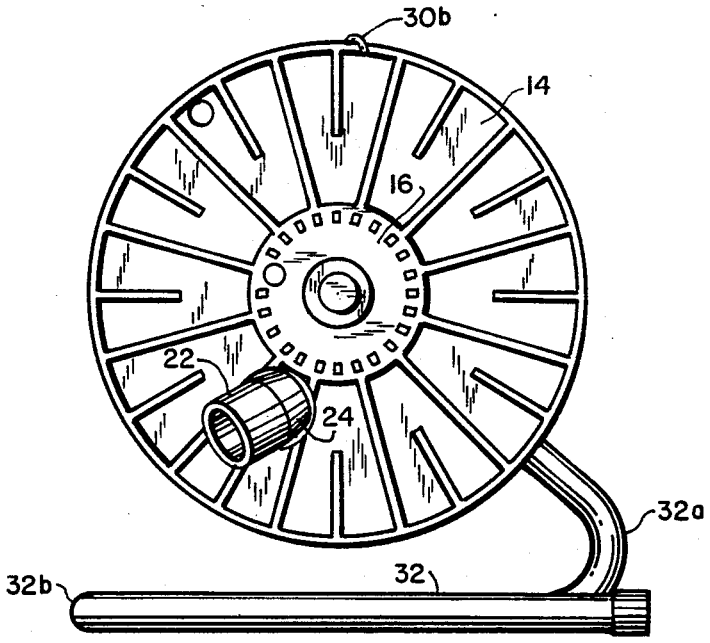
FIG. 2 is a side elevational view taken along the lines 2—2 of FIG. 1.
Figure 3:
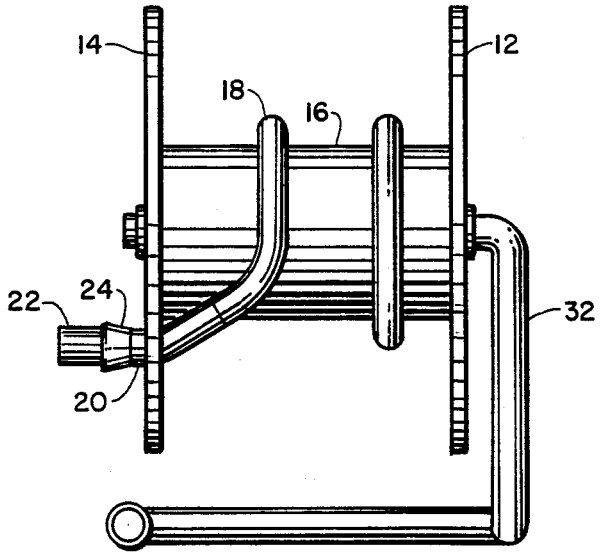
FIG. 3 is a front elevation view thereof with a few turns of the vacuum hose on the axle of the reel.
Figure 4:
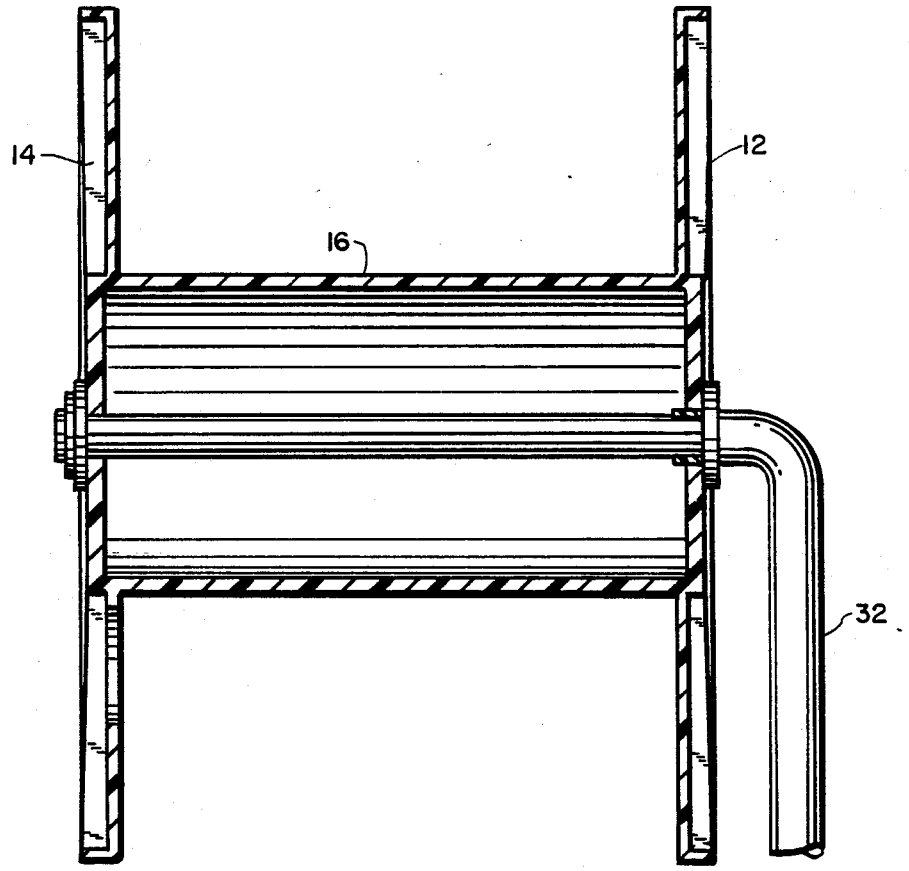
FIG. 4 is an enlarged partial sectional view of the hose reel alone.
Figure 5:
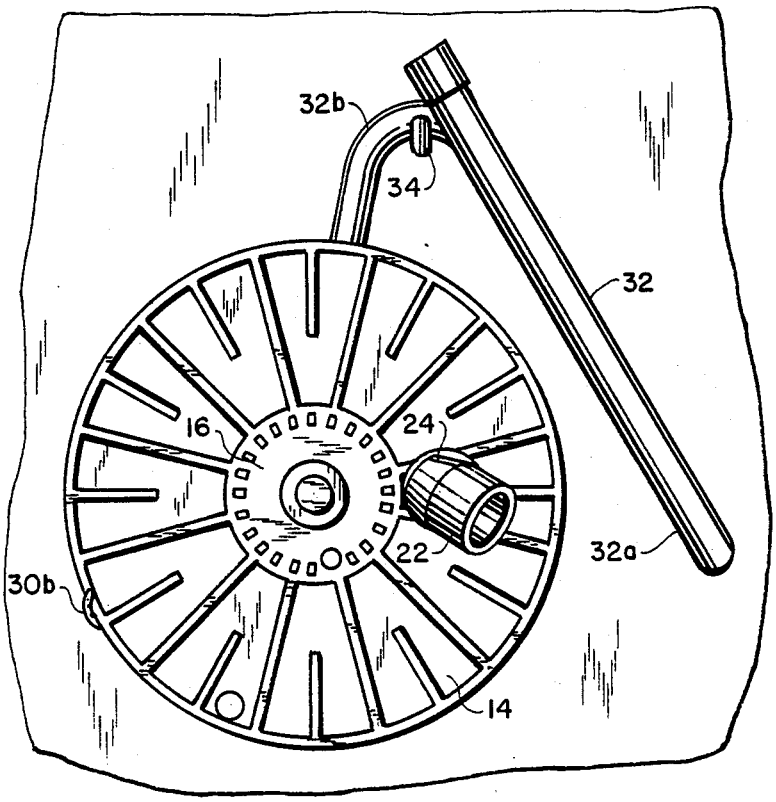
FIG. 5 is a side elevational view similar to that shown in FIG. 2 with assembly suspended from a wall hook.

A central vacuum cleaner system (not shown), which is permanently in place in a building is provided with a hose reel referred to generally by the reference numeral 10 is that includes spaced discs or flanges 12 and 14 which may be fabricated of plastic, metal or any other suitable material, and has a central axle 16 about which the lengthy vacuum cleaner hose 18 is adapted to be turned or coiled. As seen in FIGS. 2, 3 and 5 the hose reel flange 14 is provided with an opening 20 through which the end of the hose connected to the vacuum wall receptacle (not shown) is passed through. It should be evident that the end of the vacuum hose 18 passing through the opening 20 in a circular flange 14 is provided with a rigid tubular connection 22, preferably fabricated of metal, for separate coupling to various vacuum wall receptacles in the building. The tubular connection 22 is provided with an enlarged collar 24 for preventing the tubular connection 22 from being detached from the circular flange 14. The rigid tubular connection 22, as seen in FIGS. 2, 3 and 5, functions as a crank handle for the reel 10, so that by operating the same when the hose length is extended from the reel it can be coiled back on the reel by grasping the connection end 22 and turning the same thereby rotating the reel 22. As seen in FIG. 1, the opposite end of the vacuum hose 18 has another tubular connector 26, also preferably fabricated of metal, for attachment to a variety of cleaning tools for vacuuming a building or other structure. The tubular connector 26 is provided with an opening 28 in which an end **30*a* of the spring 30 is connected while the other end 30*b* of the spring 30 is removably attached to the edge of the disc 14 of the hose reel. This arrangement has the desirable result of preventing the hose 18** from being inadvertently unwrapped from the hose reel.

Figure 6:
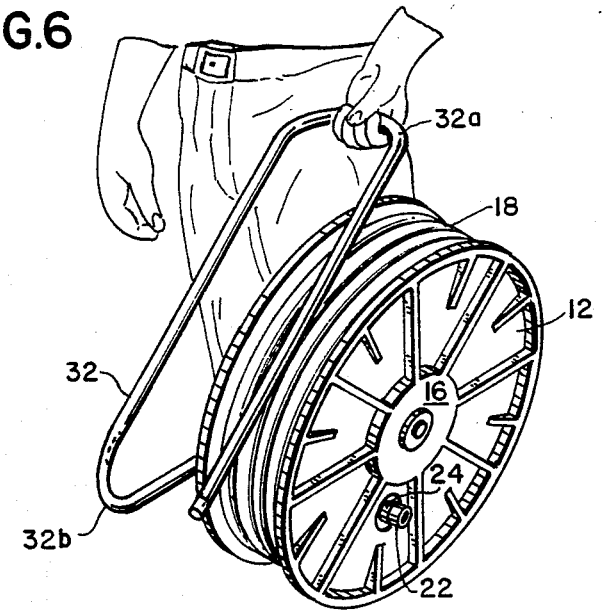
FIG. 6 is a perspective view of the hose reel and hose being transported by the user.

The hose reel 10 is rotatably supported by means of a stand 32. It should be noted from FIGS. 5 and 6 that the stand 32 is provided with a looped handle part for the purpose of transporting the lengthy hose reel from place to place, as shown in FIG. 6, and also additionally functions to store the same on a wall-mounted hanger 34, as shown in FIG. 5. Consequently, the portion **32*a* of the mounting stand 32 functions as a carrying handle while the portion 32*b*** of the mounting stand functions as a catch or support for suspending the hose reel on a wall in a building, such as a closet.

While the invention has been disclosed and illustrated in connection with a single embodiment thereof, it will be apparent that other variations and modifications may be made therein, and it is intended in the following claims to cover each such variation and modification which falls within the true spirit and scope of the invention.

What is claimed:

1. A combination portable hose reel and a hose, said real having an axle for winding a length of said hose thereon for a central vacuum cleaning system comprising: a pair of spaced flanges on said axle, one of said flanges having a hole therethrough, said hose having a rigid connecting member being a tubular connection at one end passing through the hole in said one flange whereby only said member projects outside said one flange and comprises a crank means for rotating the reel to wind the hose on the axle thereof.

2. A portable hose reel as claimed in claim 1 further comprising a resilient member having one and connected to the other end of said hose and the other end of said resilient member being removably connected to an edge of one of said flanges.

3. A portable hose reel as claimed in claim 2 wherein said resilient member is a coil spring.

4. A portable hose reel as claimed in claim 1 wherein said tubular connection which only projects through said hole is fabricated of metal and is of a sufficient length so that it may be employed as said crank handle.

5. A combination portable hose reel and a hose said reel having an axle for winding said length of hose thereon for a central vacuum cleaning system comprising: a pair of spaced flanges on said axle, a stand for said hose reel connected to said axle being so configured as to additionally function as a carrying handle for said hose reel, one of said flanges having a hole therethrough, and said hose having a rigid connecting member at one end passing through the hole in said one flange whereby said member projects outside said one flange and comprises a crank means for rotating the reel to wind the hose on the axle thereof.

6. A portable hose reel as claimed in claim 5 wherein said stand is provided with floor-engaging legs extending in a plane parallel with the plane of said flanges, and an intermediate part functioning as a carrying handle connected between said legs and extending substantially perpendicular thereto.

7. A portable hose reel as claimed in claim 6 wherein said stand is one piece and is rotatable mounted at one end in the axle of said portable reel.

* * * * *